US009366115B2

(12) United States Patent
Least et al.

(10) Patent No.: US 9,366,115 B2
(45) Date of Patent: Jun. 14, 2016

(54) JUMPER TUBE LOCKING ASSEMBLY AND METHOD

(75) Inventors: Brandon Thomas Least, Dallas, TX (US); John C. Gano, Carrollton, TX (US); Jean Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/877,451

(22) PCT Filed: Jun. 11, 2012

(86) PCT No.: PCT/US2012/041967

§ 371 (c)(1),
(2), (4) Date: Apr. 2, 2013

(87) PCT Pub. No.: WO2013/187876

PCT Pub. Date: Dec. 19, 2013

(65) Prior Publication Data

US 2013/0327542 A1 Dec. 12, 2013

(51) Int. Cl.
*E21B 43/04* (2006.01)
*E21B 17/02* (2006.01)

(52) U.S. Cl.
CPC ..... *E21B 43/04* (2013.01); *E21B 17/02* (2013.01)

(58) Field of Classification Search
USPC ..... 285/298, 301, 330, 339, 351, 369–370, 285/399–400, 403, 417, 111, 121.2, 145.1, 285/145.4, 302–303
See application file for complete search history.

(56) References Cited

U.S. PATENT DOCUMENTS

| | | | | | |
|---|---|---|---|---|---|
| 1,542,266 | A | * | 6/1925 | Palmer et al. | 285/330 |
| 2,134,719 | A | * | 11/1938 | Kocher | 285/39 |
| 2,296,198 | A | * | 9/1942 | Boynton | 285/91 |
| 3,964,771 | A | | 6/1976 | Baudouin | |
| 4,167,279 | A | * | 9/1979 | Lucksinger | 285/123.5 |
| 4,330,143 | A | * | 5/1982 | Reneau | 285/322 |
| 4,434,054 | A | | 2/1984 | Livesey et al. | |
| 4,526,230 | A | | 7/1985 | Kojicic | |

(Continued)

FOREIGN PATENT DOCUMENTS

| | | | |
|---|---|---|---|
| CN | 1060886 | A | 5/1992 |
| GB | 2021223 | A | 11/1979 |

(Continued)

OTHER PUBLICATIONS

Foreign Communication from a Related Counterpart Application, International Application No. PCT/US12/41967, International Search Report and Written Opinion, dated Feb. 13, 2013.

(Continued)

*Primary Examiner* — Aaron Dunwoody
*Assistant Examiner* — Fannie Kee
(74) *Attorney, Agent, or Firm* — Scott Richardson; Baker Botts L.L.P.

(57) ABSTRACT

A jumper tube for use with a shunt tube assembly comprises a first tubular member configured to engage a first shunt tube, a second tubular member axially disposed within the first tubular member, and a locking member configured to prevent the second tubular member from axially displacing into the first tubular member. The second tubular member is configured to slidingly engage within the first tubular member, and the second tubular member is configured to engage a second shunt tube.

16 Claims, 14 Drawing Sheets

(56) References Cited

U.S. PATENT DOCUMENTS

| | | | | |
|---|---|---|---|---|
| 4,821,800 | A | 4/1989 | Scott et al. | |
| 4,989,902 | A * | 2/1991 | Putch | 285/18 |
| 5,004,049 | A | 4/1991 | Arterbury | |
| 5,251,695 | A * | 10/1993 | Coronado | 166/242.6 |
| 5,341,880 | A | 8/1994 | Thorstensen et al. | |
| 5,390,966 | A | 2/1995 | Cox | |
| 5,415,441 | A * | 5/1995 | Kilgore et al. | 285/322 |
| 7,784,532 | B2 | 8/2010 | Sevre et al. | |
| 2005/0200127 | A1 | 9/2005 | Johnson | |
| 2006/0283604 | A1 | 12/2006 | Setterberg, Jr. et al. | |
| 2010/0163250 | A1 | 7/2010 | Schultz et al. | |

FOREIGN PATENT DOCUMENTS

| | | | |
|---|---|---|---|
| GB | 2218169 | A | 11/1989 |
| GB | 2427213 | A | 12/2006 |
| GB | 2427213 | B | 8/2007 |
| WO | 2010028158 | A1 | 3/2010 |

OTHER PUBLICATIONS

Office Action in related Chinese patent application No. 201280073868.3, mailed Nov. 27, 2015 (23 pages with translation).

First Office Action in related Australian patent application No. 2012382478 mailed Sep. 17, 2015 (3 pages).

Extended European Search Report issued in related European patent application No. 12879037.5, mailed Feb. 4, 2016 (7 pages).

International Preliminary Report on Patentability issued in related PCT application No. PCT/US12/041967, mailed Dec. 24, 2014 (6 pages).

Second Office Action in related Australian patent application No. 2012382478 mailed Feb. 10, 2016 (4 pages).

* cited by examiner

JUMPER TUBE LOCKING ASSEMBLY AND METHOD

CROSS-REFERENCE TO RELATED APPLICATIONS

This application claims priority to and is a 371 National Stage of International Application Number PCT/US2012/041967 entitled, "Jumper Tube Locking Assembly and Method", filed on Jun. 11, 2012, by Brandon Thomas Least, et al., which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open well bore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

One conventional approach to overcoming this packing sand bridging problem has been to provide each generally tubular filter section with a series of shunt tubes that longitudinally extend through the filter section, with opposite ends of each shunt tube projecting outwardly beyond the active filter portion of the filter section. In the assembled sand screen structure, the shunt tube series are axially joined to one another to form a shunt path extending along the length of the sand screen structure. The shunt path operates to permit the inflowing packing sand/gel slurry to bypass any sand bridges that may be formed and permit the slurry to enter the screen/casing annulus beneath a sand bridge, thereby forming the desired sand pack beneath it.

SUMMARY

In an embodiment, a jumper tube for use with a shunt tube assembly comprises a first tubular member configured to engage a first shunt tube, a second tubular member axially disposed within the first tubular member, and a locking member configured to prevent the second tubular member from axially displacing into the first tubular member. The second tubular member is configured to slidingly engage within the first tubular member, and the second tubular member is configured to engage a second shunt tube.

In an embodiment, a jumper tube for use with a shunt tube assembly comprises a first tubular member configured to engage a first shunt tube; a second tubular member axially disposed within the first tubular member, and a locking member engaging the outside surface of the second tubular member. The second tubular member is configured to engage a second shunt tube.

In an embodiment, a method of engaging a jumper tube to a shunt tube assembly comprises disposing a jumper tube between open ends of two shunt tubes; axially extending a second tubular member from a first tubular member to engage the open ends of the two shunt tubes; coupling at least one of the distal ends of the first tubular member and at least one of the distal ends of the second tubular member to the open ends of the two shunt tubes; and locking the second tubular member relative to the first tubular member to prevent an axially decrease in length of the jumper tube.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
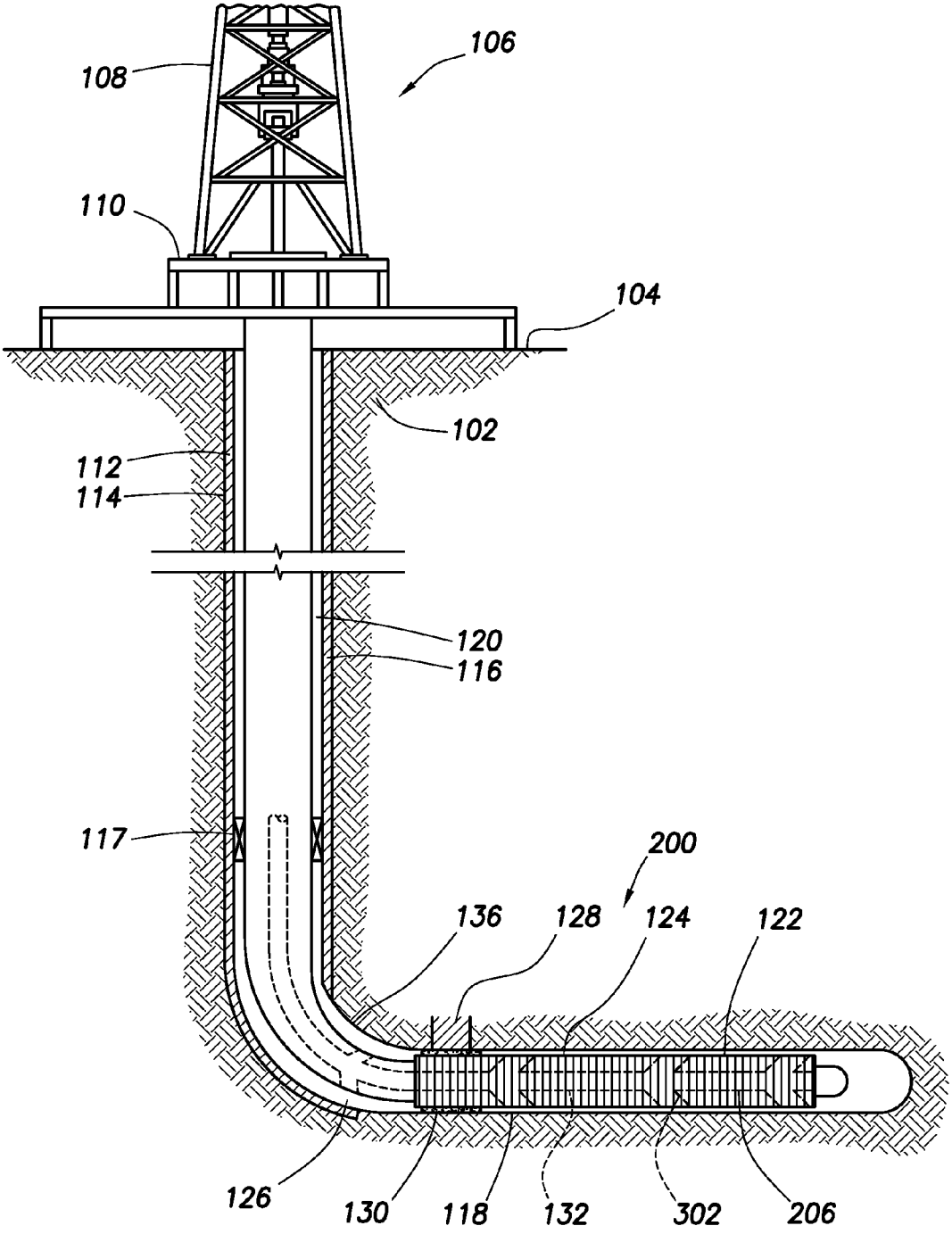
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

In order to couple shunt tubes on adjacent sections of wellbore tubular, jumper tubes may be coupled to the adjacent shunt tube ends. This process may involve disposing a short section of a tubular component between the shunt tube ends and coupling the tubular component to the shunt tubes using extensions and set screws. However, this process may be time consuming to assemble at the surface of the wellbore, and the use of set screws may be unreliable in terms of the holding force they are designed to withstand. In order to address this problem, a jumper tube assembly described herein may be used to quickly couple adjacent shunt tubes while maintaining a reliable holding force. The jumper tube assembly comprises a first tubular member, a second tubular member, and a locking mechanism. The second tubular member may axially displace within the first tubular assembly so that when the jumper tube is placed between shunt tubes, the second tubular member can be pulled from the first tubular member and fluid communication may be established between a first shunt tube and a second shunt tube.

The locking mechanism provides a quick and easy means of locking the jumper tube into place. Once the jumper tube engages two shunt tubes to allow fluid to flow from a first shunt tube to a second shunt tube, the locking member engaged to the second tubular member may be translated or rotated so that it engages both the second tubular member and the first tubular member. A gripping portion disposed on the locking member and a gripping component disposed on the second tubular member engage each other allowing the locking member to move axially along the second tubular until it makes contact with the first tubular member. However, once the locking member makes contact with the first tubular member the gripping portions prevent the locking member from moving away from the first tubular member along the axis of the second tubular member. This feature allows for quick and easy installation of jumper tubes while providing a safe and reliable bridge between shunt tubes.

Referring to FIG. 1, an example of a wellbore operating environment in which a well screen assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore 114 may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore 114 may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string comprising a well screen assembly 122, which in turn comprises a shunt tube assembly, disposed in the wellbore 114. It should be understood that the wellbore tubular 120 is equally applicable to any type of wellbore tubulars being inserted into a wellbore including as non-limiting examples drill pipe, casing, liners, jointed tubing, and/or coiled tubing. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, screen assemblies 122, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.). While FIG. 1 illustrates a single screen assembly 122, the wellbore tubular 120 may comprise a plurality of screen assemblies 122. The zonal isolation devices 117 may be used between various ones of the screen assemblies 122, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 122 can be positioned in the wellbore 114 as part of the wellbore tubular string 120 adjacent a hydrocarbon bearing formation. An annulus 124 is formed between the screen assembly 122 and the wellbore 114. A gravel slurry 126 may travel through the annulus 124 between the well screen assembly 122 and the wellbore 114 wall as it is pumped down the wellbore 114 around the screen assembly 122. Upon encountering a section of the subterranean formation 102 including an area of highly permeable material 128, the highly permeable area 128 can draw liquid from the slurry, thereby dehydrating the slurry. As the slurry dehydrates in the permeable area 128, the remaining solid particles form a sand bridge 130 and prevent further filling of the annulus 124 with gravel. One or more shunt tubes 132 may be used to create an alternative path for gravel around the sand bridge 130. The shunt tube 132 allows a slurry of sand to enter an apparatus and travel in the shunt tube 132 past the sand bridge 130 to reenter the annulus 124 downstream. The shunt tube 132 may be placed on the outside of the wellbore tubular 120 or run along the interior thereof.

Figure 2:
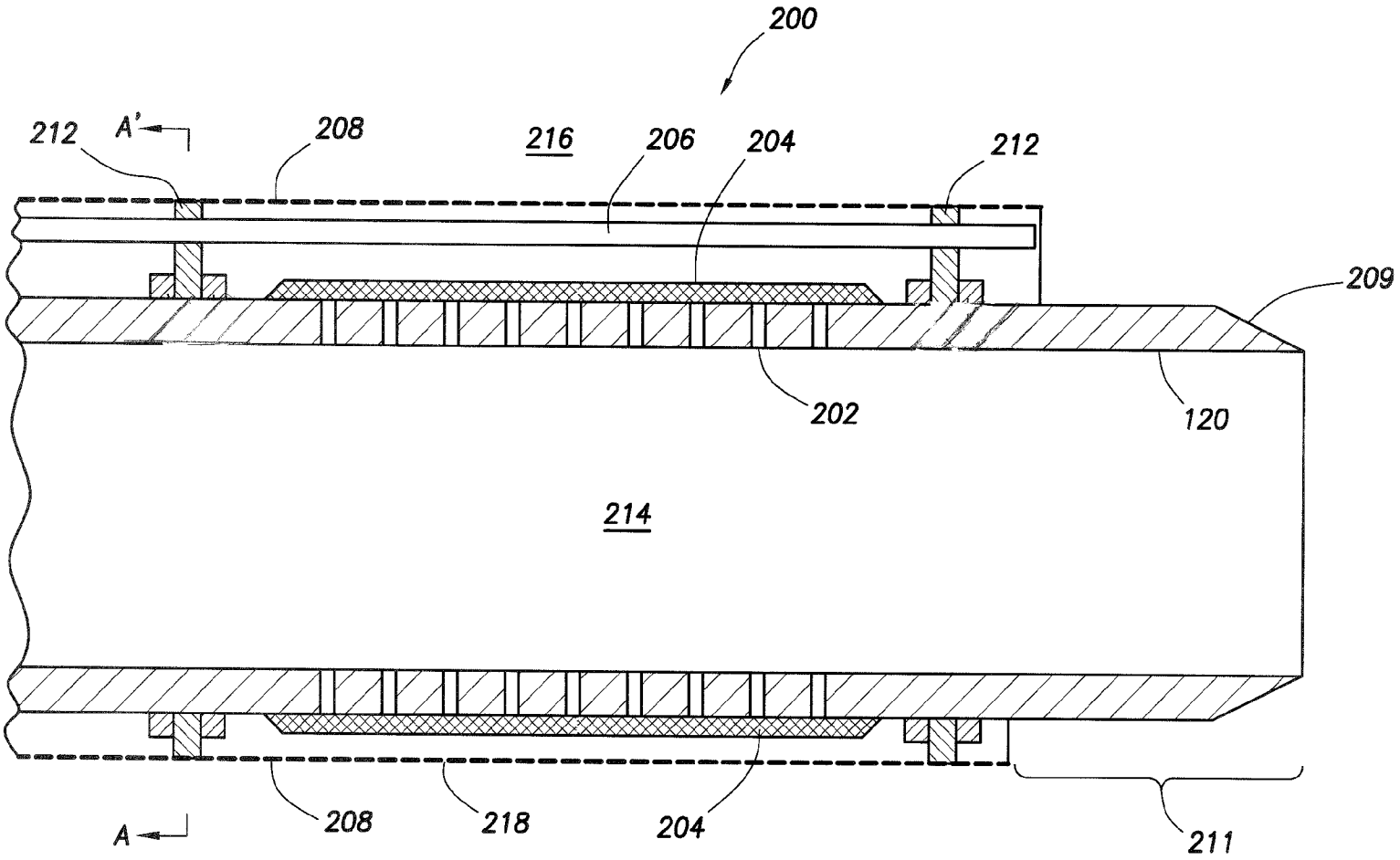
FIG. 2 is a cross-sectional view of an embodiment of a shunt tube assembly.

A cross-sectional view of an embodiment of an individual joint of wellbore tubular comprising a shunt tube assembly 200 disposed thereabout is shown in FIG. 2. The wellbore tubular 120 generally comprises a series of perforations 202 disposed therethrough. A filter media 204 is disposed about the wellbore tubular 120 and the series of perforations 202 to screen the incoming fluids from the formation. The shunt tube assembly 200 comprises one or more retaining rings 212 and one or more shunt tubes 206 disposed along and generally parallel to the wellbore tubular 120. An outer body member 208 may be disposed about the wellbore tubular 120, one or more shunt tubes 206, and filter media 204. In an embodiment, the retaining rings 212 are configured to retain the one or more shunt tubes 206 and/or outer body member 208 in position relative to the wellbore tubular 120.

The wellbore tubular 120 comprises the series of perforations 202 through the wall thereof. The wellbore tubular 120 may comprise any of those types of wellbore tubular described above with respect to FIG. 1. While the wellbore tubular 120 is illustrated as being perforated in FIG. 2, the wellbore tubular 120 may be slotted and/or include perforations of any shape so long as the perforations permit fluid communication of production fluid between an interior throughbore 214 and an exterior 216 of the shunt tube assembly 200.

The wellbore tubular 120 may generally comprise a pin end 209 and a box end to allow the wellbore tubular 120 to be coupled to other wellbore tubulars having corresponding connections. As can be seen in FIG. 2, the wellbore tubular 120 may have an exposed portion 211 that acts as coupling section that extends beyond the shunt tube assembly 200. The exposed portion 211 of the wellbore tubular 120 may be used during the coupling process to allow one or more tools to engage the exposed portion 211 and thread the joint to an adjacent joint of wellbore tubular. In an embodiment, the exposed portion 211 may be about 1 to about 5 feet, or alternatively about 2 feet to about 4 feet, though any distance suitable for allowing the wellbore tubular 120 to be coupled to an adjacent joint of wellbore tubular may be used.

The filter media 204 may be disposed about the wellbore tubular 120 and can serve to limit and/or prevent the entry of sand, formation fines, and/or other particulate matter into the wellbore tubular 120. In an embodiment, the filter media 204 is of the type known as "wire-wrapped," since it is made up of a wire closely wrapped helically about a wellbore tubular 120, with a spacing between the wire wraps being chosen to allow fluid flow through the filter media 204 while keeping particulates that are greater than a selected size from passing between the wire wraps. While a particular type of filter media 204 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

Figure 3:
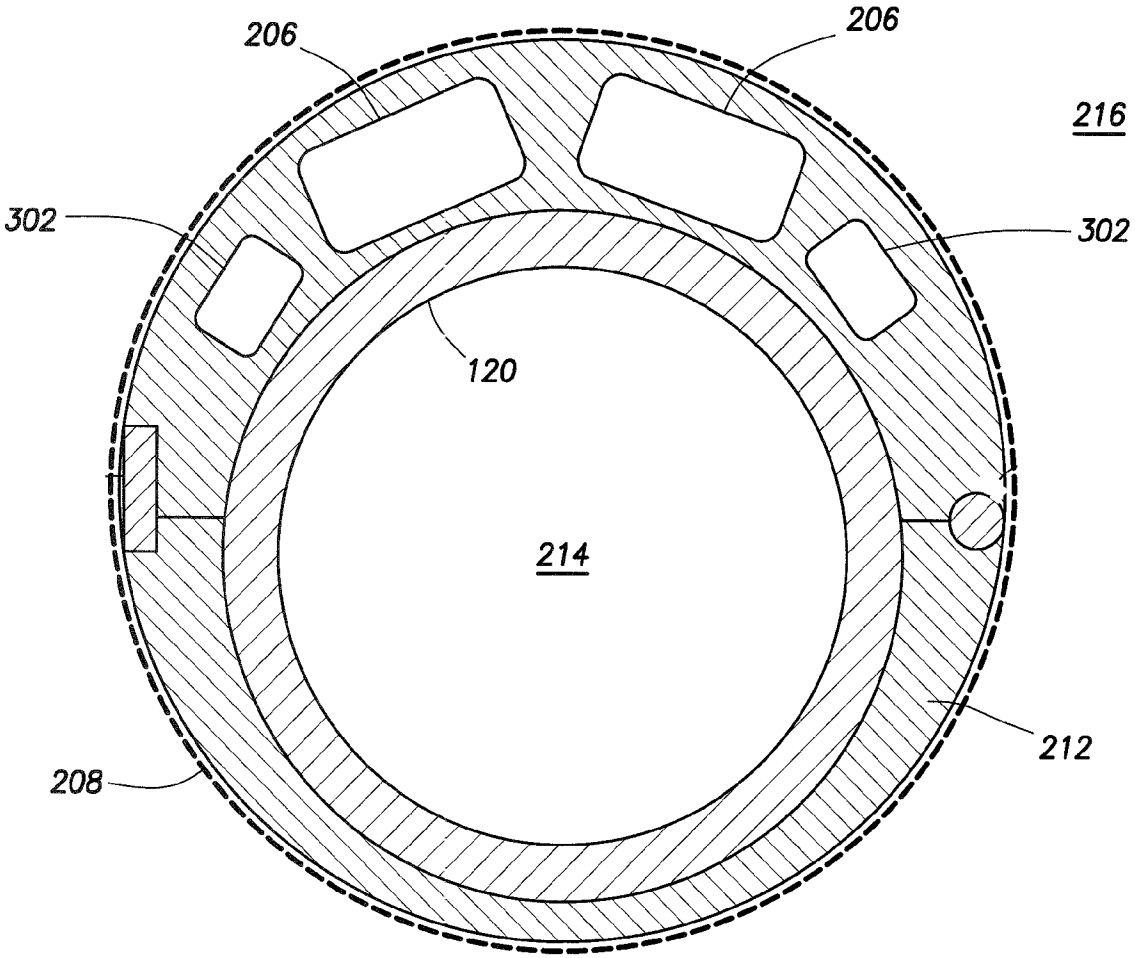
FIG. 3 is a cross-sectional view of an embodiment of a shunt tube assembly along line A-A' of FIG. 2.

The one or more shunt tubes 206 generally comprise tubular members disposed outside of and generally parallel to the wellbore tubular 120, though other positions and alignment may be possible. While described as tubular members (e.g., having substantially circular cross-sections), the one or more shunt tubes 206 may have shapes other than cylindrical and may generally be rectangular, elliptical, kidney shaped, and/or trapezoidal in cross-section. The retaining rings 212 may retain the shunt tubes 206 in position relative to the wellbore tubular 120. The one or more shunt tubes 206 may be eccentrically aligned with respect to the wellbore tubular 120 as best seen in FIG. 3. In this embodiment, four shunt tubes 206, 302 are arranged to one side of the wellbore tubular 120 within the outer body member 208. While illustrated in FIGS. 2 and 3 as having an eccentric alignment, other alignments of the one or more shunt tubes about the wellbore tubular 120 may also be possible.

Various configurations for providing fluid communication between the interior of the one or more shunt tubes 206 and the exterior 216 of the outer body member 208 are possible. In an embodiment, the one or more shunt tubes 206 may comprise a series of perforations (e.g., openings and/or nozzles). Upon the formation of a sand bridge, a back pressure generated by the blockage may cause the slurry carrying the sand to be diverted through the one or more shunt tubes 206 until bypassing the sand bridge. The slurry may then pass out of the one or more shunt tubes 206 through the perforations in both the shunt tubes 206 and outer body member 208 and into the annular space between the wellbore tubular and casing/wellbore wall to form a gravel pack.

In an embodiment, the shunt tubes 206 may comprise transport tubes and/or packing tubes 302. The one or more packing tubes 302 may be disposed in fluid communication with the one or more transport tubes. As illustrated in FIGS. 1 and 3, the packing tubes 302 may generally comprise tubular members disposed outside of and generally parallel to the wellbore tubular 120. The transport tubes and packing tubes 302 may be disposed generally parallel to the wellbore tubular 120 and may be retained in position relative to the wellbore tubular 120 by the retaining rings 212. A first end of the packing tubes 302 may be coupled to the one or more transport tubes at various points along the length of the transport tubes, and the packing tubes may comprise a series of perforations providing fluid communication within and/or through the outer body member 208 at a second end. As shown schematically in FIG. 1, the shunt tubes may form a branched structure along the length of a screen assembly 122 with the one or more transport tubes forming the trunk line and the one or more packing tubes 302 forming the branch lines.

In use, the branched configuration of the transport tubes and packing tubes 302 may provide the fluid pathway for a slurry to be diverted around a sand bridge. Upon the formation of a sand bridge, a back pressure generated by the blockage may cause the slurry carrying the sand to be diverted through the one or more transport tubes 206 until bypassing the sand bridge. The slurry may then pass out of the one or more transport tubes 206 into the one or more packing tubes 302. While flowing through the one or more packing tubes 302, the slurry may pass through the perforations in the packing tubes 302 and into the annular space about the wellbore tubular 120 to form a gravel pack.

To protect the shunt tubes 206 and/or filter media 204 from damage during installation of the screen assembly comprising the shunt tube assembly 200 within the wellbore, the outer body member 208 may be positioned about a portion of the shunt tube assembly 200. The outer body member 208 comprises a generally cylindrical member formed from a suitable material (e.g. steel) that can be secured at one or more points, for example to the retaining rings 212, which in turn, are secured to wellbore tubular 120. The outer body member 208 may have a plurality of openings 218 (only one of which is numbered in FIG. 2) through the wall thereof to provide an exit for fluid (e.g., gravel slurry) to pass through the outer body member 208 as it flows out of one or more openings in the shunt tubes 206 (e.g., through openings in the packing tubes 302), and/or an entrance for fluids into the outer body member 208 and through the permeable section of the filter media 204 during production. By positioning the outer body member 208 over the shunt tube assembly 200, the shunt tubes 206 and/or filter media 204 may be protected from any accidental impacts during the assembly and installation of the screen assembly in the wellbore that might otherwise damage or destroy one or more components of the screen assembly or the shunt tube assembly 200.

As illustrated in FIGS. 2 and 3, the shunt tubes 206, outer body member 208, and/or in some embodiments, the filter media 204, can be retained in position relative to the wellbore tubular 120 using the retaining rings 212. The retaining rings 212 generally comprise rings and/or clamps configured to engage and be disposed about the wellbore tubular 120. The retaining ring 212 may engage the wellbore tubular using any suitable coupling including, but not limited to, corresponding surface features, adhesives, curable components, spot welds, any other suitable retaining mechanisms, and any combination thereof. For example, the inner surface of the retaining ring 212 may comprise corrugations, castellations, scallops, and/or other surface features, which in an embodiment, may be aligned generally parallel to the longitudinal axis of the wellbore tubular 120. The corresponding outer surface of the wellbore tubular 120 may comprise corresponding surface features that, when engaged, couples the retaining rings 212 to the wellbore tubular 120.

FIG. 3 illustrates a cross-sectional view along line A-A' of FIG. 2 that shows the cross section of a retaining ring 212. In the embodiment shown in FIG. 3, the retaining ring extends around the wellbore tubular 120. A plurality of through passages are provided in the retaining ring 212 to allow the one or more shunt tubes 206, 302 to pass through a portion of the retaining ring 212. The retaining ring 212 may also be configured to engage and retain the outer body member 208 in position about the wellbore tubular 120.

While the joints of wellbore tubular described herein are generally described as comprising a series of perforations 202 and filter media 204, one or more joints of wellbore tubular 120 may only have the shunt tube assemblies disposed thereabout. Such a configuration may be used between joints of wellbore tubular 120 comprising production sections to act as spacers or blank sections while still allowing for a continuous fluid path through the shunt tubes 206 along the length of the interval being completed.

In an embodiment, an assembled sand screen structure can be made up of several joints of the wellbore tubular comprising the shunt tube assemblies 200 described herein. During the formation of the assembled sand screen structure, the shunt tubes 206 on the respective joints are fluidly connected to each other as the joints are coupled together to provide a continuous flowpath for the gravel slurry along the entire length of assembled sand screen structure during gravel packing operations.

In order to couple joints of wellbore tubulars, adjacent joints comprising screens may be connected by threading together adjacent joints using a threaded coupling (e.g., using timed threads) to substantially align the shunt tubes on the adjacent joints. The end of each shunt tube on the adjacent joints may then be individually coupled using a connector such as a jumper tube. A typical jumper tube comprises of relatively short length of tubing which has a coupling assembly at each end for connecting the jumper tube to the shunt tubes. Typically, the jumper tube may be assembled onto the aligned shunt tubes after the adjacent joints of wellbore tubular are coupled together.

Figure 4:
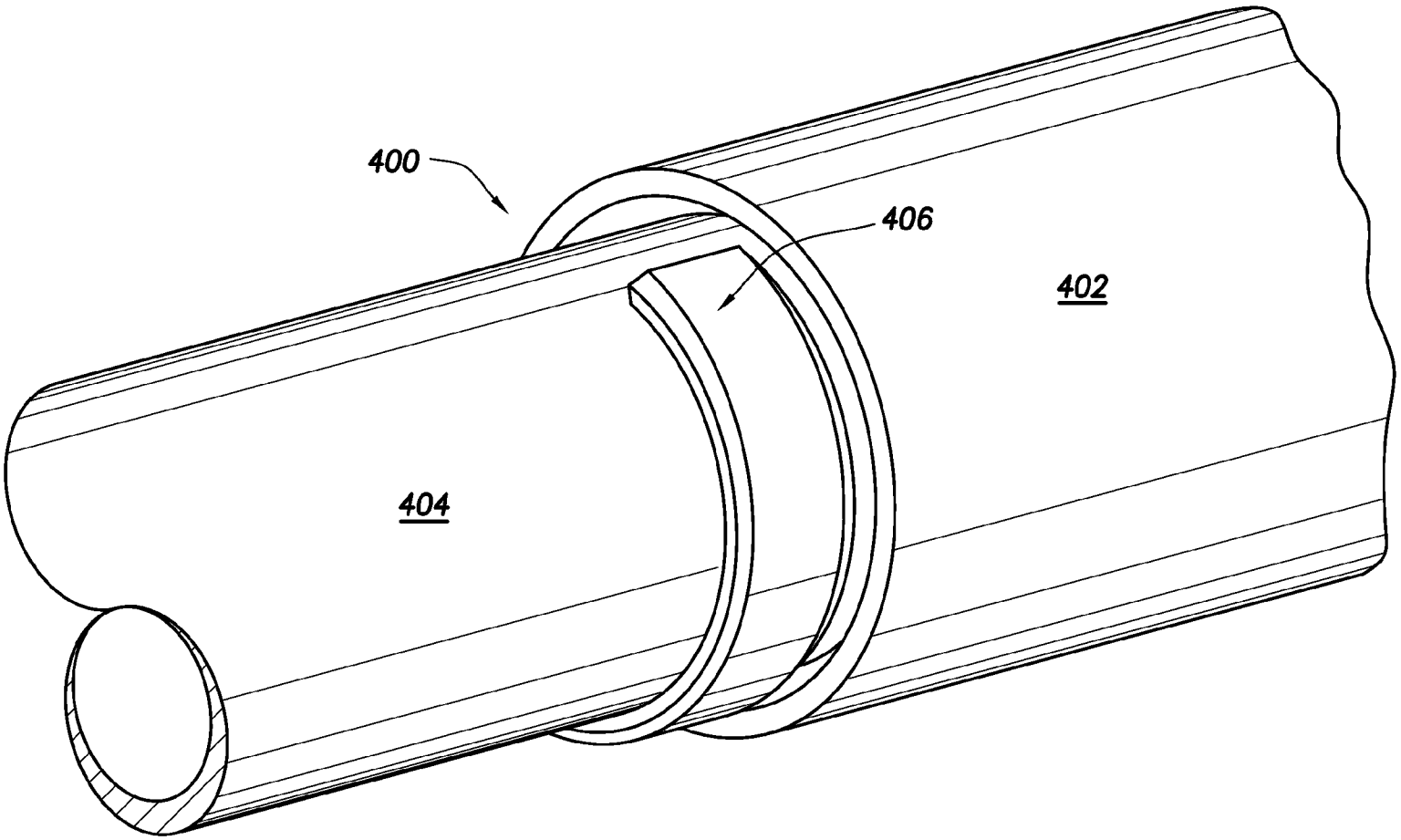
FIG. 4 is a partial view of embodiments of a jumper tube assembly.

As shown in FIG. 4, jumper tube 400 comprises a first tubular member 402 and a second tubular member 404, and a locking member 406 may be disposed about at least a portion of the jumper tube 400. The second tubular member 404 slidingly engages within the first tubular member 402. The second tubular member 404 is configured to axially slidingly displace from at least one distal end of the first tubular member 402 to extend the length of the jumper tube 400 so that jumper tube 400 may couple with at least one shunt tube. At least one distal end of the first tubular member 402 and at least one distal end of the second tubular member 404 are configured to engage shunt tubes, such as shunt tubes 206 depicted in FIG. 2 and FIG. 3. In an embodiment, the cross-section of the first tubular member 402 and the second tubular member 404 may be round, elliptical, or of a polygonal shape. The locking member 406 engages an outer surface of the second tubular member 404 and also engages a portion of the first tubular member 402, as further described herein. The locking member 406 is configured to prevent the second tubular member 404 from axially displacing back into the first tubular member 402 when the second tubular member 404 extends out of the first tubular member 402.

The sliding relationship between the first tubular member 402 and the second tubular member 404 is such that the inside diameter of the first tubular member 402 and the outside diameter of the second tubular member 404 are substantially similar and configured to allow the second tubular member to be disposed within the first tubular member. A first seal between the first tubular member 402 and the second tubular member 404 may be used to create a sealing engagement between the first tubular member 402 and the second tubular member 404, thereby preventing fluid from passing into or out of the jumper tube 400 at the location where the first tubular member 402 and the second tubular member 404 meet while still allowing for axial movement of the second tubular member 402 within the first tubular member 404.

Figure 5:
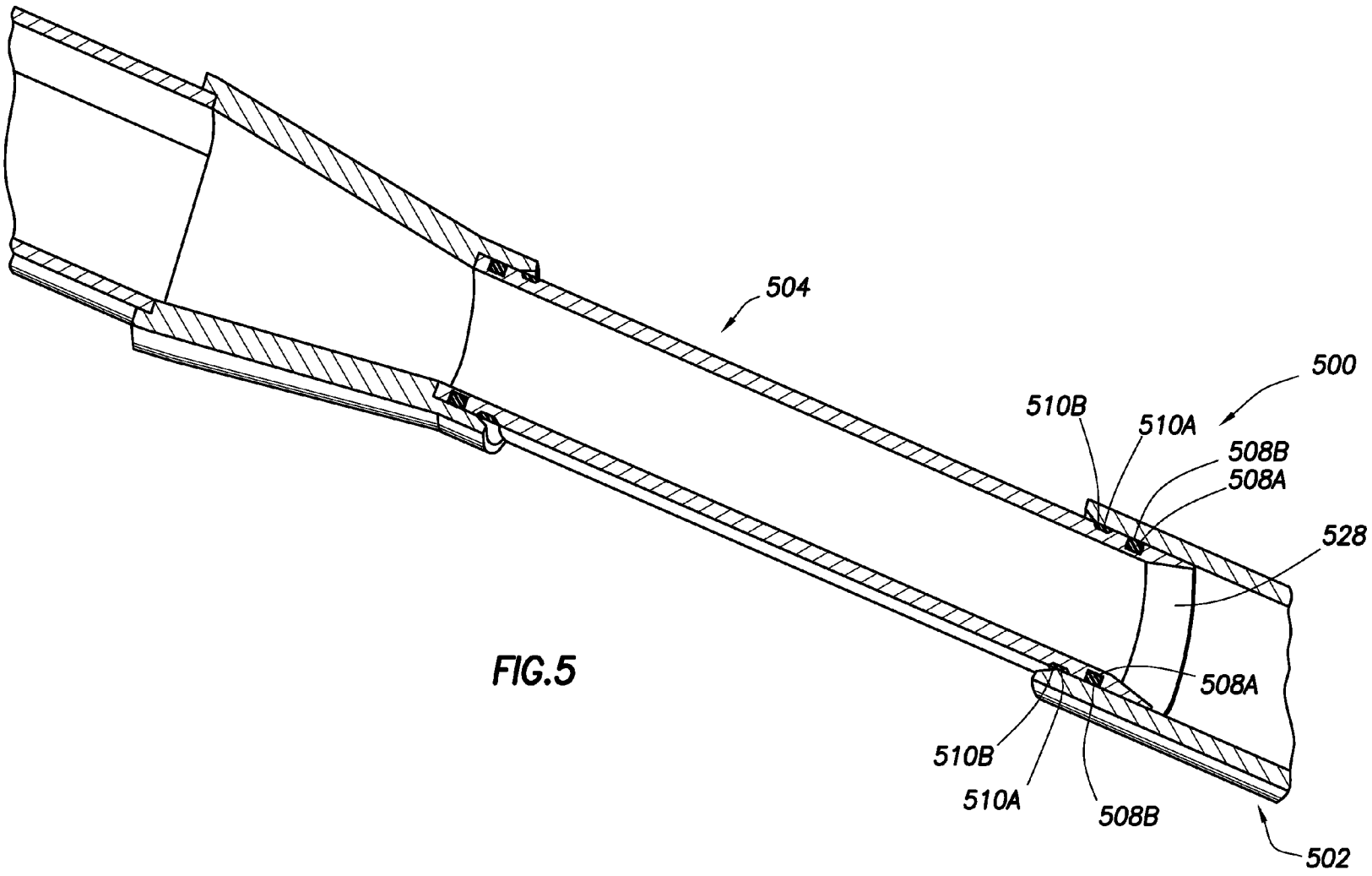
FIG. 5 is a partial cross-sectional view of an embodiment of a jumper tube assembly.

A cross-section of an embodiment of the jumper tube 500 is depicted in FIG. 5. As previously illustrated in FIG. 4, the first tubular member 502 is configured so that the second tubular member 504 may slidingly axially displace within the first tubular member 502 while providing a first seal preventing fluid from passing into or out of the jumper tube 500. A fluid flow transition 528 is disposed within the second tubular member 504 so that inside diameter of at least a portion of the second tubular member 504 axially increases towards at least one distal end of the second tubular member 504 as the outside diameter of the second tubular member remains substantially constant. In an embodiment, the inside diameter and the outside diameter of the second tubular member 504 may be substantially similar at the distal end of the second tubular member where the fluid flow transition 528 is located. The fluid flow transition 528 is configured to transition fluid flow axially through the jumper tube 500 at the location where the second tubular member 504 and the first tubular member 502 meet.

A seal 508A and an optional back-up seal 510A may be disposed between the first tubular member 502 and the second tubular member 504 to provide a second sealing engagement and/or an optional back-up sealing engagement between the first tubular member 502 and the second tubular member 504, thereby preventing fluid from passing into or out of the jumper tube 500 at the location where the first tubular member 502 and the second tubular member 504 meet while still allowing for axial movement of the second tubular member 504 within the first tubular member 502. As depicted in FIG. 5, the seal 508A is housed in a seal housing 508B disposed within the second tubular member 504 and the optional back-up seal 510A is housed in an optional back-up seal housing 510B disposed within the second tubular member 504. In an embodiment, the seal housing 508B and/or the optional back-up seal housing 510B may be disposed in the first tubular member 502. In an embodiment, an optional seal back-up may be used in combination with any of the seals.

When a fluid is displacing through and/or over a jumper tube 500, for example, the jumper tube 500 will not permit fluid from passing between the first tubular member 502 and the second tubular member 504 due to the use of at least one seal. A first seal may prevent fluid from passing between the first tubular member 502 and the second tubular member 504 due to the substantially similar outside diameter of the second tubular member 504 axially displaced within the first tubular member 502 and the inside diameter of the first tubular member 504. A second seal and/or a second optional back-up seal may prevent fluid from passing between the first tubular member 502 and the second tubular member 504 due to the seal 508A housed in the seal housing 508B and the optional seal back-up 510A housed in the optional seal back-up housing 510B. Due to at least one of these seals, fluid may not pass into or out of the jumper tube 500 at the location where the first tubular member 502 and the second tubular member 504 meet while still allowing for axial movement of the second tubular member 504 within the first tubular member 502.

Figure 6A:
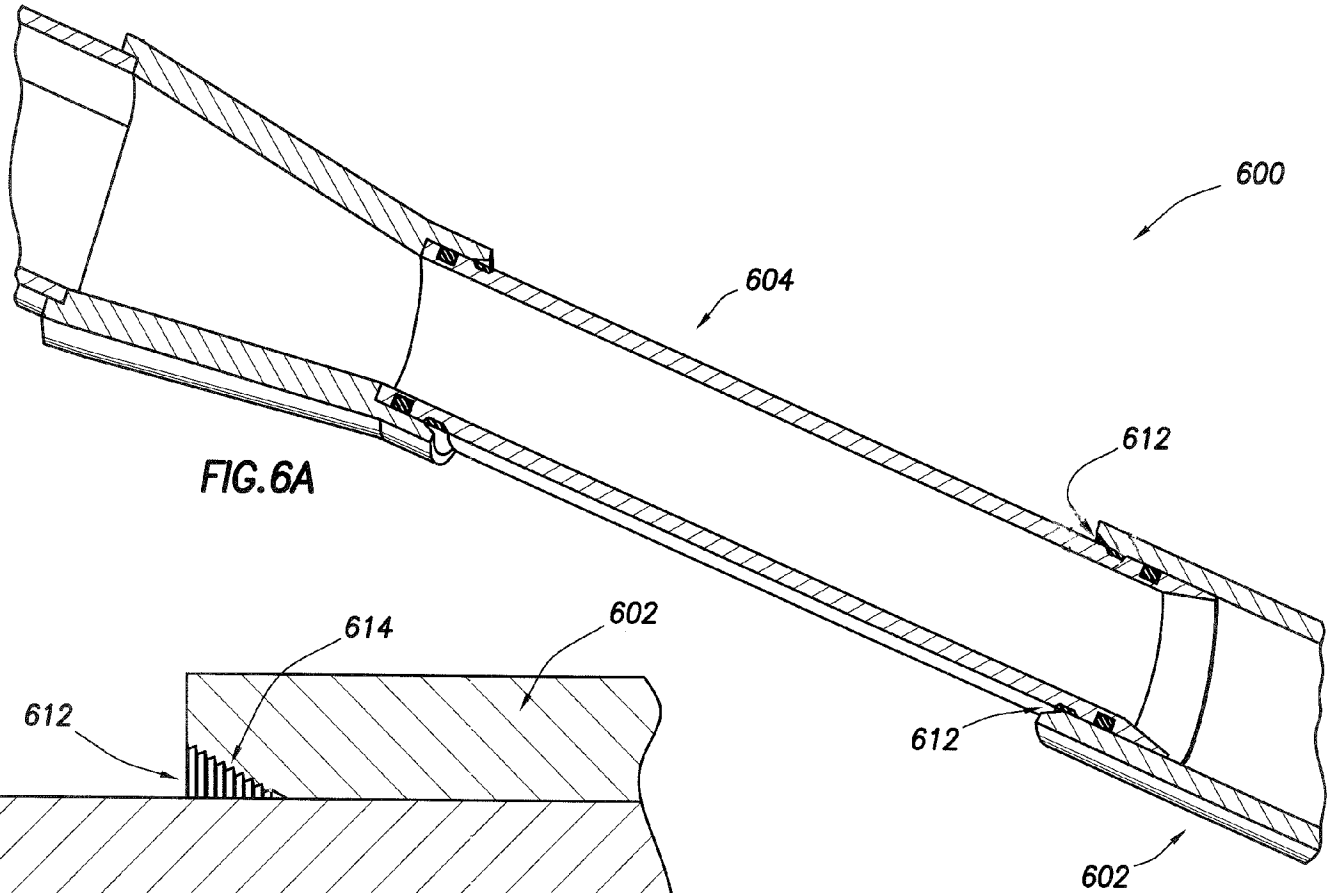
FIG. 6A is a partial cross-sectional view of an embodiment of a jumper tube assembly.

As disclosed in FIG. 6A, a jumper tube 600 has a locking member housing 612 disposed at the distal end of the first tubular member 602. The locking member housing 612 is configured to engage a least a portion of the locking member 406, depicted in FIG. 4, to secure the engagement of the locking member 406 to the first tubular member 602 and the second tubular member 604. The locking member housing 612 may be disposed between the first tubular member 602 and the second tubular member 604 so that the inside diameter of at least a portion of the first tubular member 602 axially increases towards at least one distal end of the first tubular member 602 as the outside diameter of the first tubular member 602 remains substantially axially constant. In an embodiment, the locking member housing 612 may comprise a beveled, angled, arced, and/or rounded housing. In an embodiment, the locking member housing 612 may be disposed at both distal ends of the first tubular member 602. However, the locking member housing 612 may be preferred at least on the distal end of the first tubular member 602 configured to engage the second tubular member 504.

Figure 6B:
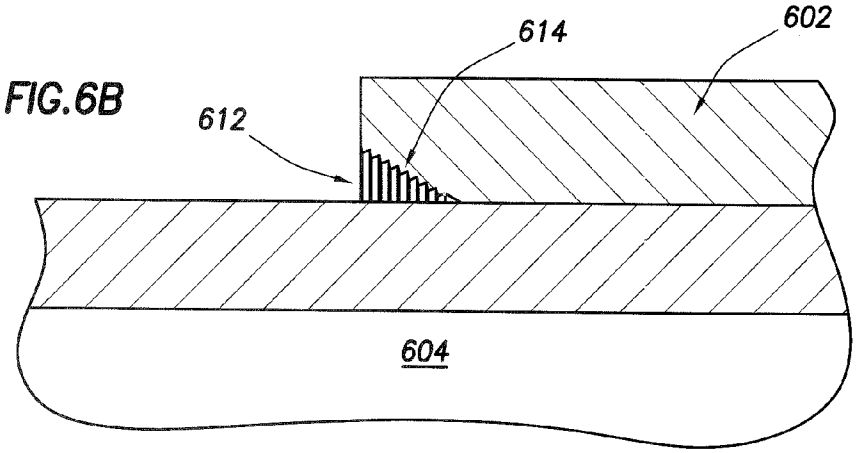
FIG. 6B is a partial cross-sectional view of an embodiment of a jumper tube assembly.

As disclosed in FIG. 6B, the locking member housing 612 may comprise surface features 614 such as frictional grooves disposed on at least a portion of the inside diameter of the first tubular member 602. The surface features 614 may be configured to engage the surface of the locking member 406, depicted in FIG. 4, to secure the engagement of the locking member 406 to the first tubular member 602 and the second tubular member 604. In an embodiment, the surface features 614 of the locking member housing 612 may comprise at least one zero lead thread disposed circumferentially around the inside diameter of the first tubular member 602. In an embodiment, the surface features 614 of the locking member housing 612 may comprise a non-smooth and/or rough surface configured to prevent movement between locking member 406 and the first tubular member 602 as well as movement between the locking member 406 and the second tubular member 604.

Figure 7A:
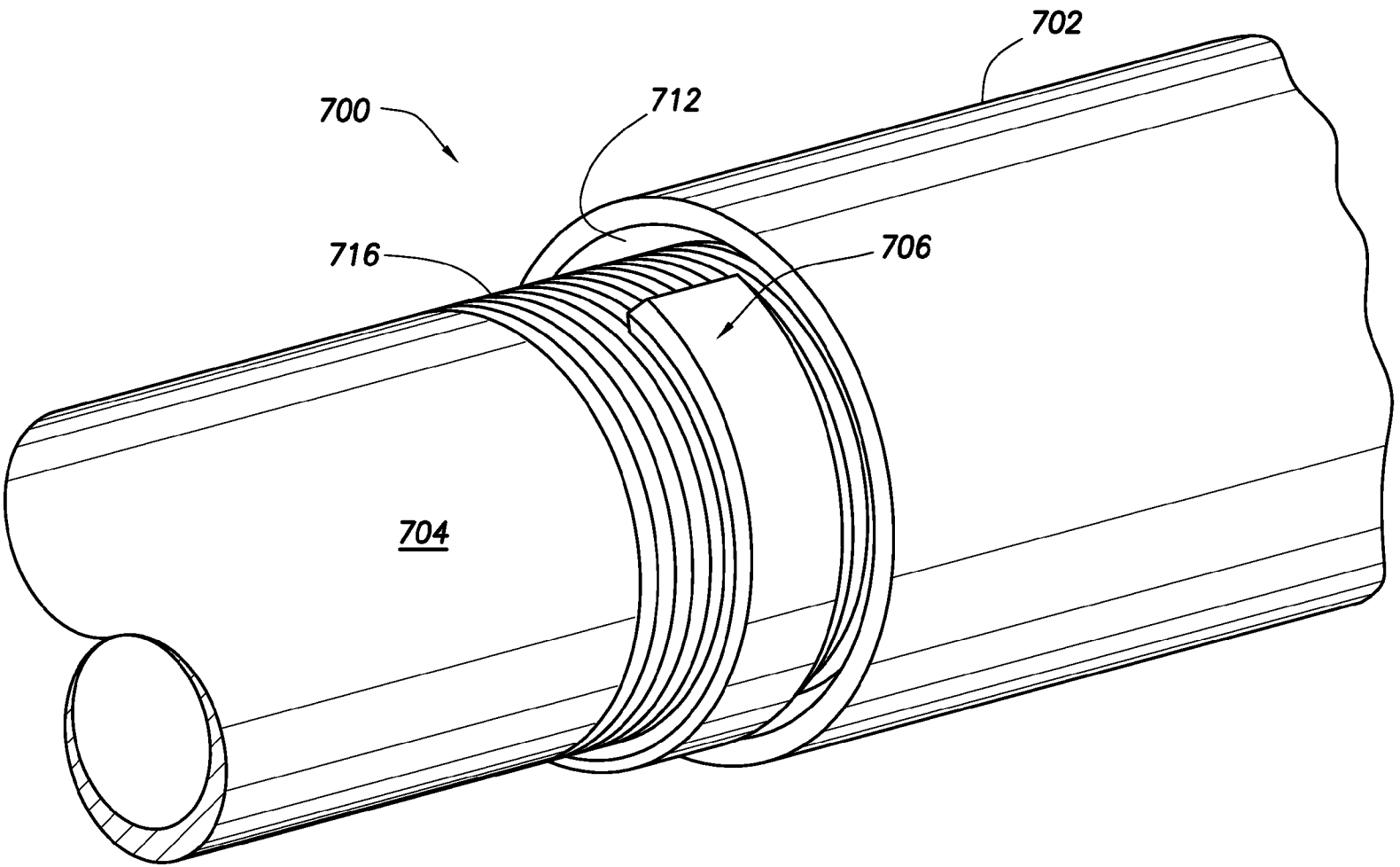
FIG. 7A is a partial view of embodiments of a jumper tube assembly.

FIG. 7A discloses an embodiment of the jumper tube 700 with surface features such as grooves 716 disposed on the second tubular member 704. The second tubular member 704 is configured to axially slidingly displace relative to at least one distal end of the first tubular member 702 to extend the length of the jumper tube 700 so that jumper tube 700 may couple with at least one shunt tube, such as shunt tubes 206 depicted in FIG. 2 and FIG. 3. In an embodiment, at least a portion of the outside diameter of the second tubular member 704 is disposed with grooves 716. The grooves 716 may engage the locking member 706 and may be configured to prevent axial movement of the locking member 706 along the axis of the second tubular member 704. In an embodiment, the configuration of the grooves 716 may be such that the engagement between the grooves 716 and the locking member 706 may permit axial movement of the locking member 706 in a single direction, for example, in the direction towards the first tubular member 702, thereby holding the jumper tube in an extending position while permitting the jumper tube to extend further. In an embodiment, the grooves 716 may be helical with either a right hand lead or a left hand lead. In an embodiment, the grooves 716 may be circumferential and have zero lead. In an embodiment, the grooves 716 may have an inclined lower face 718 and a flat upper face 720, as disclosed in FIG. 7B, to permit axial movement of the locking member 706 only in the direction towards the first tubular member 702. The lower faces may be similar to a series of axially spaced apart and circumferentially extended "ramps". Such a configuration may also be known as "buttress" threads.

Figure 7B:
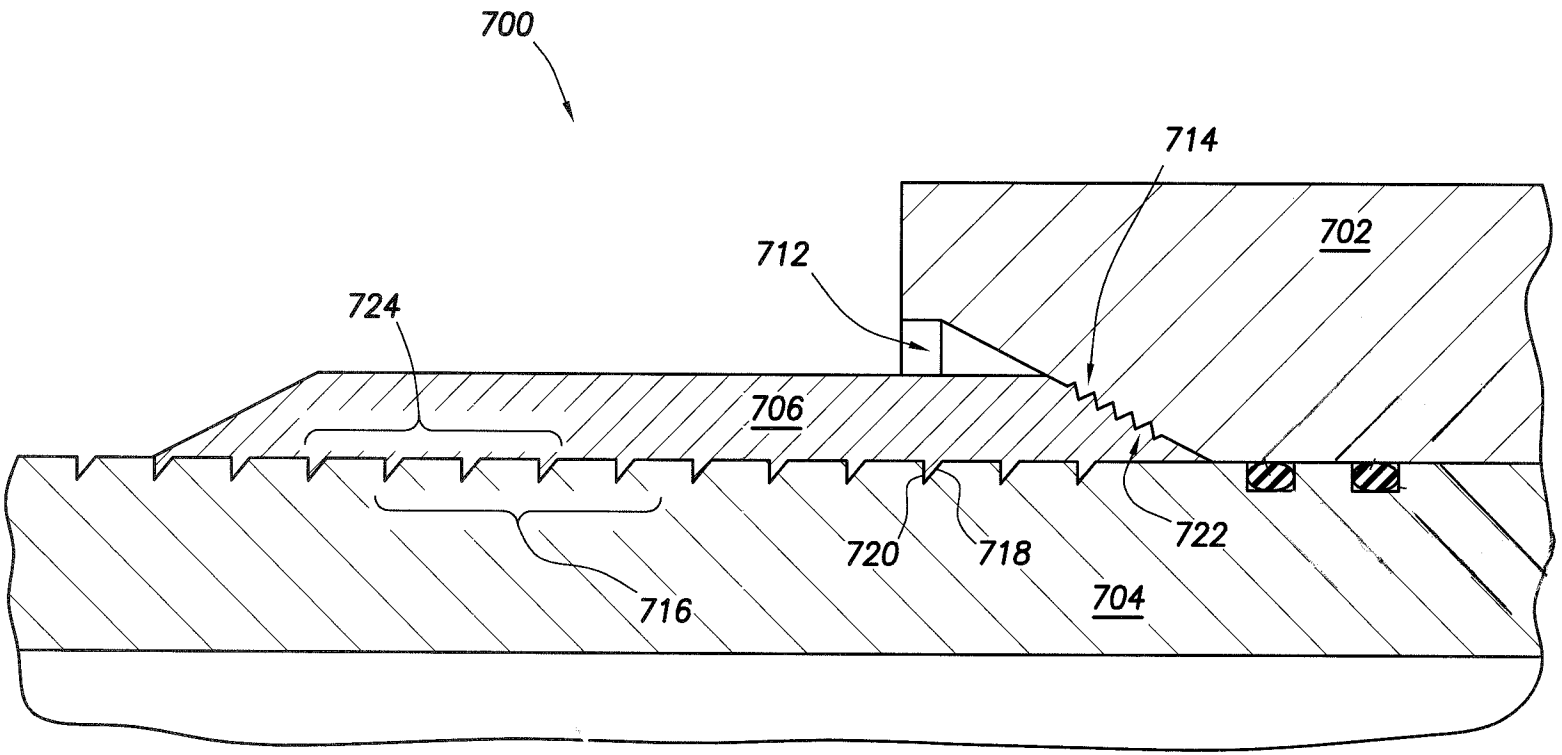
FIG. 7B is a partial cross-sectional view of an embodiment of a jumper tube assembly.

FIG. 7B also discloses an embodiment of the locking member 706 engaging the first tubular member 702. In an embodiment, the locking member 706 may comprise a c-ring. In an embodiment, the locking member 706 may comprise a tube clamp. The locking member 706 engages at least a portion of the first tubular member 702 inside the locking member housing 712. In an embodiment, the locking member 706 may not engage the first tubular member 702 in a locking member housing 712. Instead the locking member 706 may engage a side wall of the first tubular member 702. Furthermore, at least a portion of the surface of the locking member 706 may engage the first tubular member 702. In an embodiment, the first tubular member 702 may engage the locking member 706 on a beveled surface of the locking member 706. In an embodiment, the first tubular member 702 may engage the locking member 706 on the outside surface of the locking member 706. The locking member 706 may comprise frictional grooves 722 disposed on at least one face of the locking member 706 and may be configured to complimentarily engage the frictional grooves 714 disposed on the inside diameter of the first tubular member 702. The engagement of the frictional grooves 722 and the friction groove 714 may prevent the locking member 706 from moving out of engagement with the first tubular member 702 and the second tubular member 704. In an embodiment, the frictional grooves 722 may be a non-smooth surface and/or a rough surface. In an embodiment, the frictional grooves 722 may be at least one zero lead thread disposed circumferentially around the diameter of the locking member 706 and configured to complimentarily engage the frictional groove 714 disposed on the inside diameter of the first tubular member 702.

FIG. 7B also discloses the locking member 706 engaging the second tubular member 704. The locking member 706 may be disposed around at least a portion of the circumference of the second tubular member 704. Grooves 724 may be disposed on the surface of the locking member 706 in contact with the outside diameter of the second tubular member 704. The grooves 724 may be configured to complimentarily engage the grooves 716 and may be configured to prevent axial movement of the locking member 706 along the axis of the second tubular member 704. In an embodiment, the configuration of the grooves 724 may be such that the engagement between the grooves 724 and the groves 716 may permit axial movement of the locking member 706 only in the direction towards the first tubular member 702. In an embodiment, the grooves 724 may be helical with either a right hand lead or a left hand lead. In an embodiment, the grooves 724 may be circumferential and have zero lead. In an embodiment, the grooves 724 may have an inclined lower face 718 and a flat upper face 720 to permit axial movement of the locking member 706 only in the direction towards the first tubular member 702. The lower faces may be similar to a series of axially spaced apart and circumferentially extended "ramps". Such a configuration may also be known as "buttress" threads. In an embodiment, both the grooves 716 and the grooves 724 may be non-smooth surfaces configured to prevent axial movement of the locking member 706 along the axis of the second tubular member 704. In an embodiment, the locking member 706 may be engaged to the second tubular member through a magnetic force which secures the locking member 706 to the second tubular member 704 and prevents axial movement of the locking member 706 along the axis of the second tubular member 704.

Figure 7C:
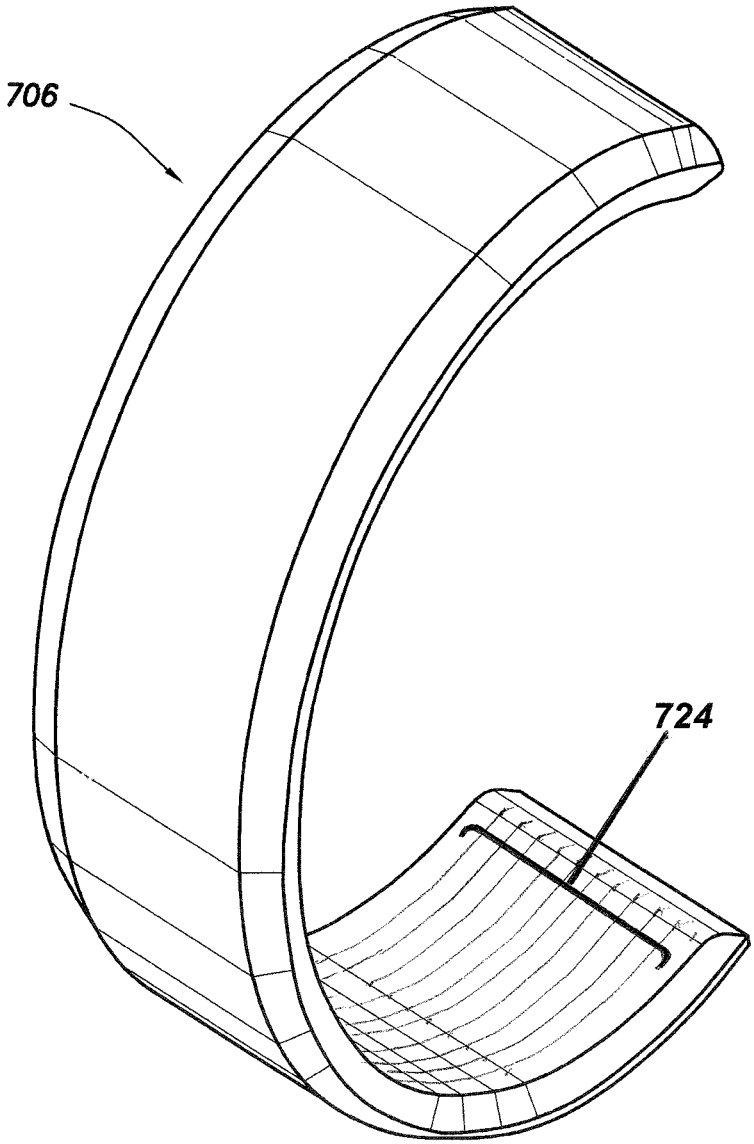
FIG. 7C is a view of an embodiment of a locking member.

When the jumper tube 700 is extended and coupled with at least one shunt tube, the locking member 706 may be inserted on the second tubular member 704. An embodiment of the locking member 706 is depicted in FIG. 7C. In an embodiment, the locking member 706 may be inserted before the jumper tube 700 is coupled with at least one shunt tube. After the jumper tube 700 is coupled with at least one shunt tube and after the locking member is engaged to the second tubular member 704, the locking member 706 may engage with first tubular member 702. In an embodiment, the locking member 706 may be axially translated along the second tubular member 704 until contact is made between the first tubular member 702 and the locking member 706. In an embodiment grooves 724 disposed with the locking member 706 may move over grooves 716 disposed with the second tubular member 704. In this embodiment, it is not required that the locking member 706 be twisted or turned around the second tubular member 704 as it moves axially towards the first tubular member 702 into engagement. In an embodiment, the grooves 716 of the second tubular member 704 are helical in either a right hand lead or a left hand lead and the grooves 724 of the locking member 706 are configured to complimentarily engage the grooves 716 of the second tubular member 704 so that to move the locking member 706 along the axis of the second tubular member 704, the locking member 706 may be twisted or turned around the outside diameter of the second tubular member 704 until the locking member engages with the first tubular member 702. Once the locking member 706 engages first tubular member 702, the coupling of grooves 716 with grooves 724 prevent the locking member from axially displacing from the first tubular member 702

In an embodiment the locking member 706 may engage the first tubular member 702 in the locking member housing 712. In an embodiment, frictional grooves 722 disposed on at least one surface of the locking member 706 may engage complimentary frictional grooves 714 disposed on the inside diameter of the first tubular member 702. This engagement may hold the locking member 706 in engagement with first tubular member 702 and the second tubular member 704.

Figure 8:
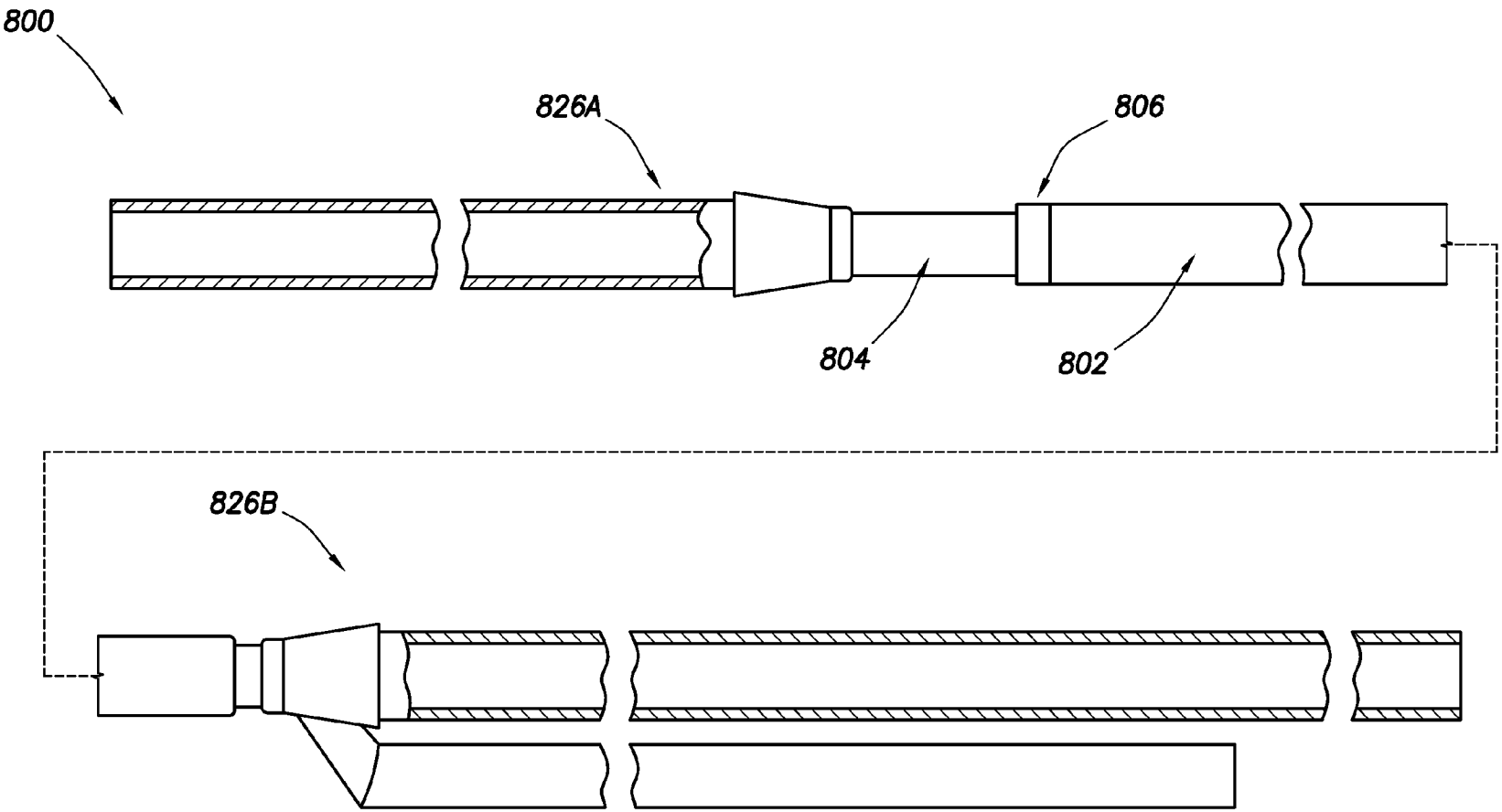
FIG. 8 is a partial view of an embodiment of a shunt tube assembly.

As shown in FIG. 8, the locking member 806 may be engaged with first tubular member 802 and the second tubular member 804. The jumper tube 800 may also be coupled to the shunt tubes 826A and 826B as discussed in further detail herein. In an embodiment, the locking member 806 is configured to prevent disengagement between the jumper tube 800 and the shunt tubes 826A and 826B by holding the second tubular member 804 in the extended position, axially extended from within the first tubular member 802. Furthermore, the locking member 806 may be configured to maintain sealing engagement between the first tubular member 802 and the shunt tube 826A as well as sealing engagement between the second tubular member 804 and the shunt tube 826B. Additionally, the locking member 806 may be configured to provide sealing engagement between the first tubular member 802 and the second tubular member 804 to prevent fluid from passing into or out of the jumper tube 800 at the location where the first tubular member 802 and the second tubular member 804 meet.

Figure 9:
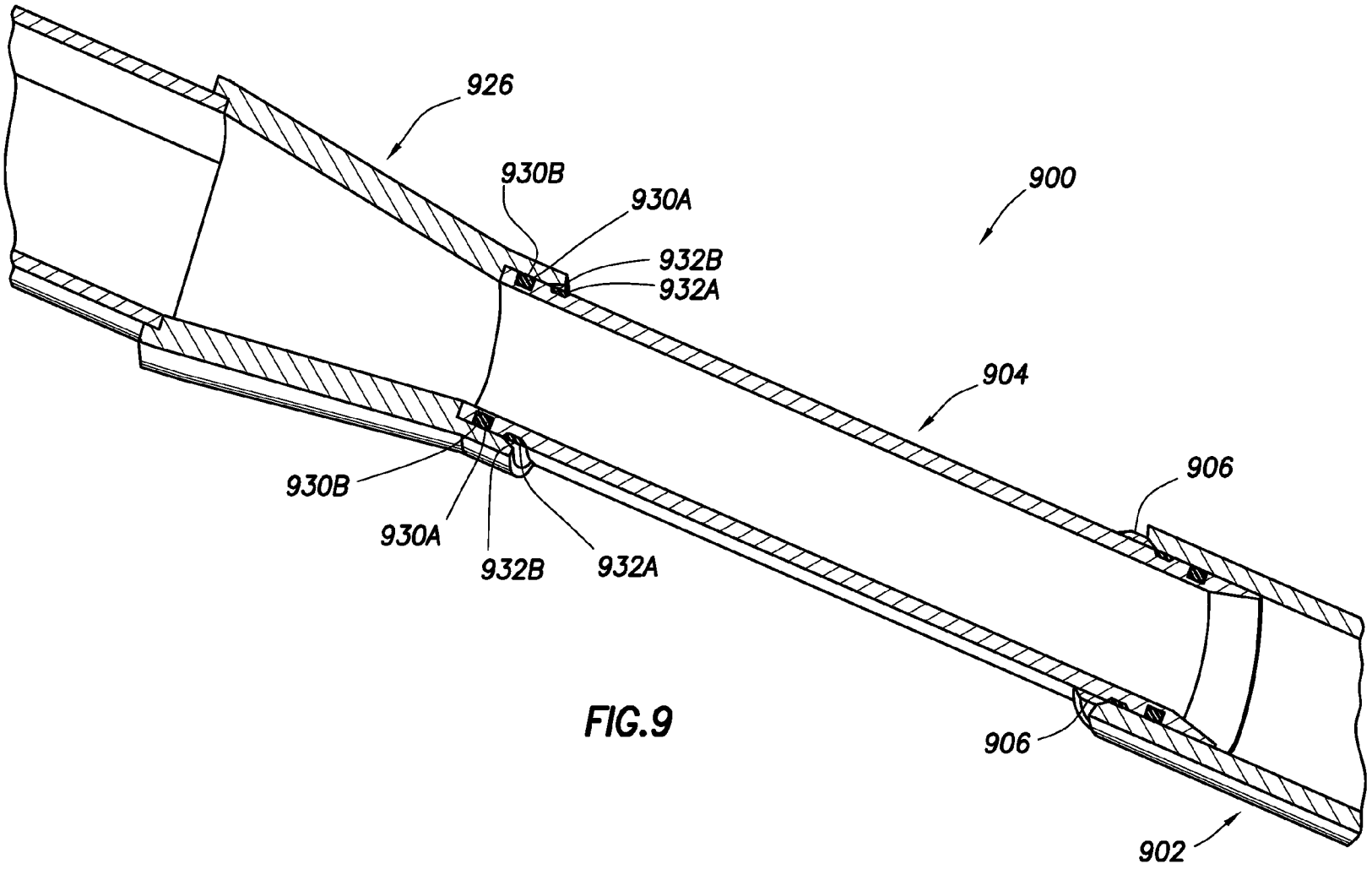
FIG. 9 is a partial cross-sectional view of an embodiment of a jumper tube assembly.

As disclosed in FIG. 9, the second tubular member 904 of the jumper tube 900 engages the shunt tube 926. In an embodiment, the first tubular member 902 may also engage another shunt tube (not shown). A seal 930A and an optional back-up seal 932A disposed between the shunt tube 926 and the second tubular member 904 may provide a sealing engagement and/or an optional back-up sealing engagement between the shunt tube 926 and the second tubular member 904, thereby preventing fluid from passing into or out of the jumper tube 900 at the location where the shunt tube 926 and the second tubular member 904 meet. The seal 930A may be housed in a seal housing 930B disposed within the second tubular member 904, and the optional back-up seal 932A may be housed in an optional back-up seal housing 932B disposed within the second tubular member 904. In an embodiment, the seal housing 930B and/or the optional back-up seal housing 932B may be disposed in the shunt tube 926. Additionally, the seal and optional back-up seal configuration previously discloses may also be disposed in engagement between the first tubular member 902 and a shunt tube (not shown).

When a fluid is displacing through and/or over jumper tube 900 and shunt tube 926, for example, the engagement between the second tubular member 904 and shunt tube 926 may limit or prevent fluid from passing between the first tubular member 902 and the second tubular member 904 due to the at least one seal. A first seal may be created by the tension provided from the locking member 906 engaged with first tubular member 902 and the second tubular member 904 as secured into place by the grooves 716 and 724 and the locking member housing 712 as shown in FIG. 7. This tension may limit or prevent fluid from passing between the shunt tube 926 and the second tubular member 904. A second seal and/or a second optional back-up seal may also prevent fluid from passing between the shunt tube 926 and the second tubular member 904 due to the seal 930A housed in the seal housing 930B and the optional back-up seal 932A housed in the optional back-up seal housing 932B. Due to at least one of these seals, fluid may not pass into or out of the jumper tube 500 at the location where the shunt 926 and the second tubular member 904 meet.

Figure 10:
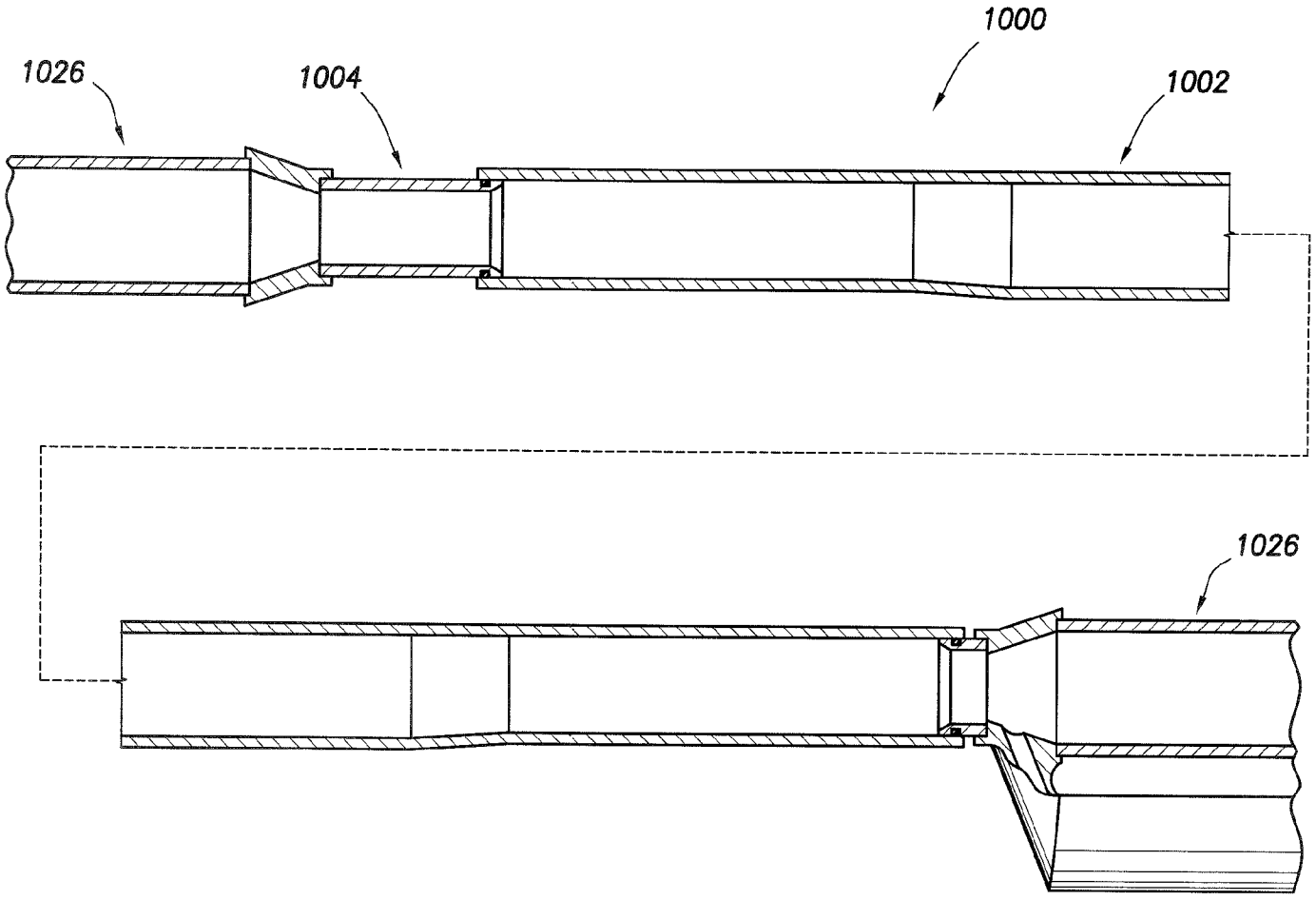
FIG. 10 is a partial cross-sectional view of an embodiment of a jumper tube assembly.

FIG. 10 discloses connections between the jumper tube 1000 and one or more shunt tubes 1026. At least one distal end of the first tubular member 1002 and at least one distal end of the second tubular member 1004 may be configured to engage with the shunt tube assembly. In an embodiment, the outside diameter of at least one of the distal ends of first tubular member 1002 and/or the outside diameter of at least one of the distal ends of the second tubular member 1004 may be decreased to sealingly engage the jumper tube 1000 with the shunt tube 1026. In an embodiment the outside diameter of at least one of the distal ends of first tubular member 1002 and/or the outside diameter of at least one of the distal ends of the second tubular member 1004 may be increased to sealingly engage the jumper tube 1000 with the shunt tube 1026.

Figure 11A:
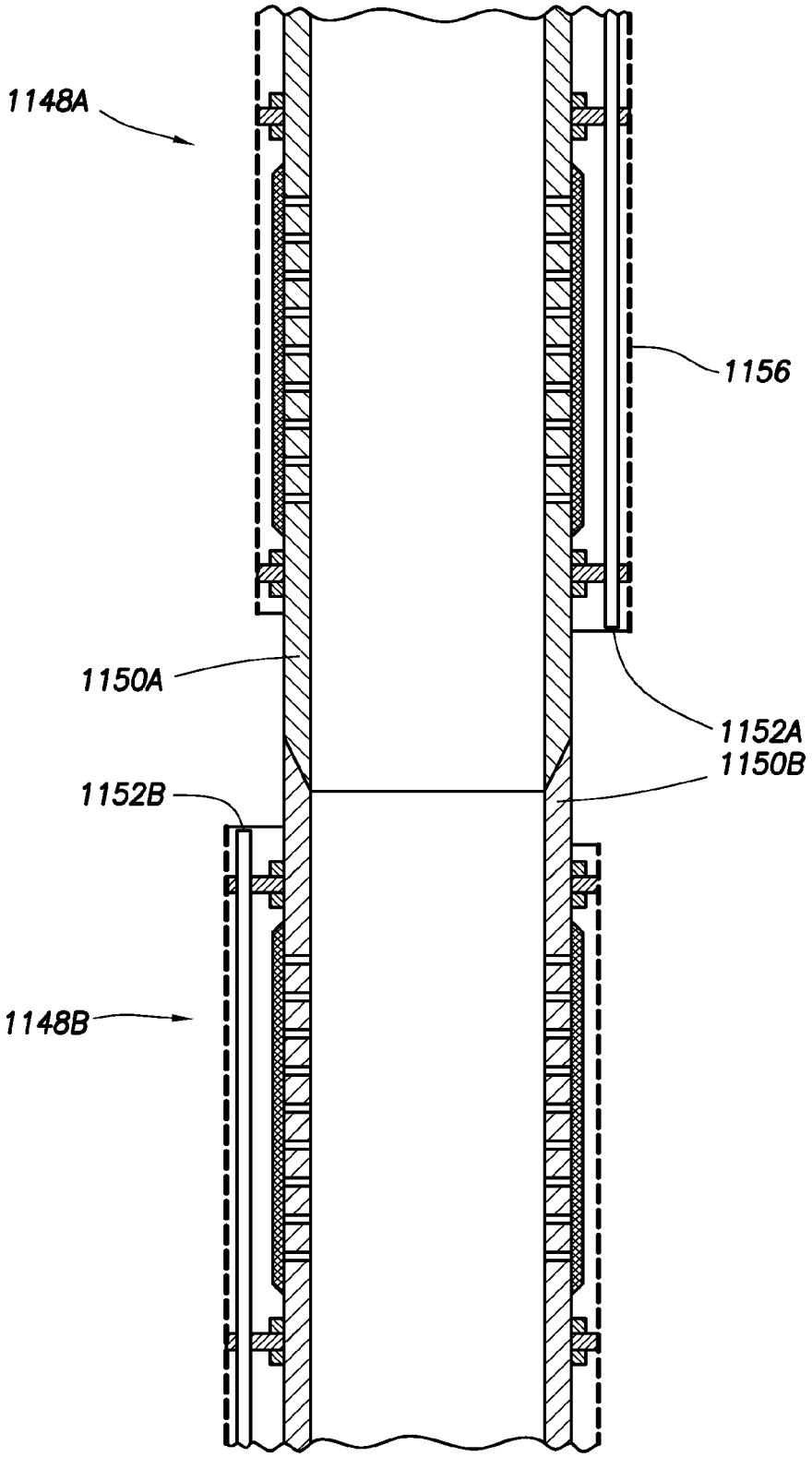
FIGS. 11A and 11B are cross-sectional views of an embodiment of a shunt tube assembly during an embodiment of a coupling process.

As shown in FIG. 11A, the coupling process may begin with coupling a first joint of wellbore tubular 1150A comprising a shunt tube assembly 1148A to a second joint of wellbore tubular 1150B comprising a shunt tube assembly 1148B. The wellbore tubular sections 1150A, 1150B may generally comprise a pin and box type connection that can be threaded together and torqued according to standard connection techniques. Once coupled, the end of a first shunt tube 1152A of the first shunt tube assembly 1148A may be substantially aligned with the adjacent end of a second shunt tube 1152B of the second shunt tube assembly 1148B. In an embodiment, the shunt tubes 1152A, 1152B may be considered substantially aligned if they are aligned to within about 10 degrees, about 7 degrees, or about 5 degrees of each other.

Figure 11B:
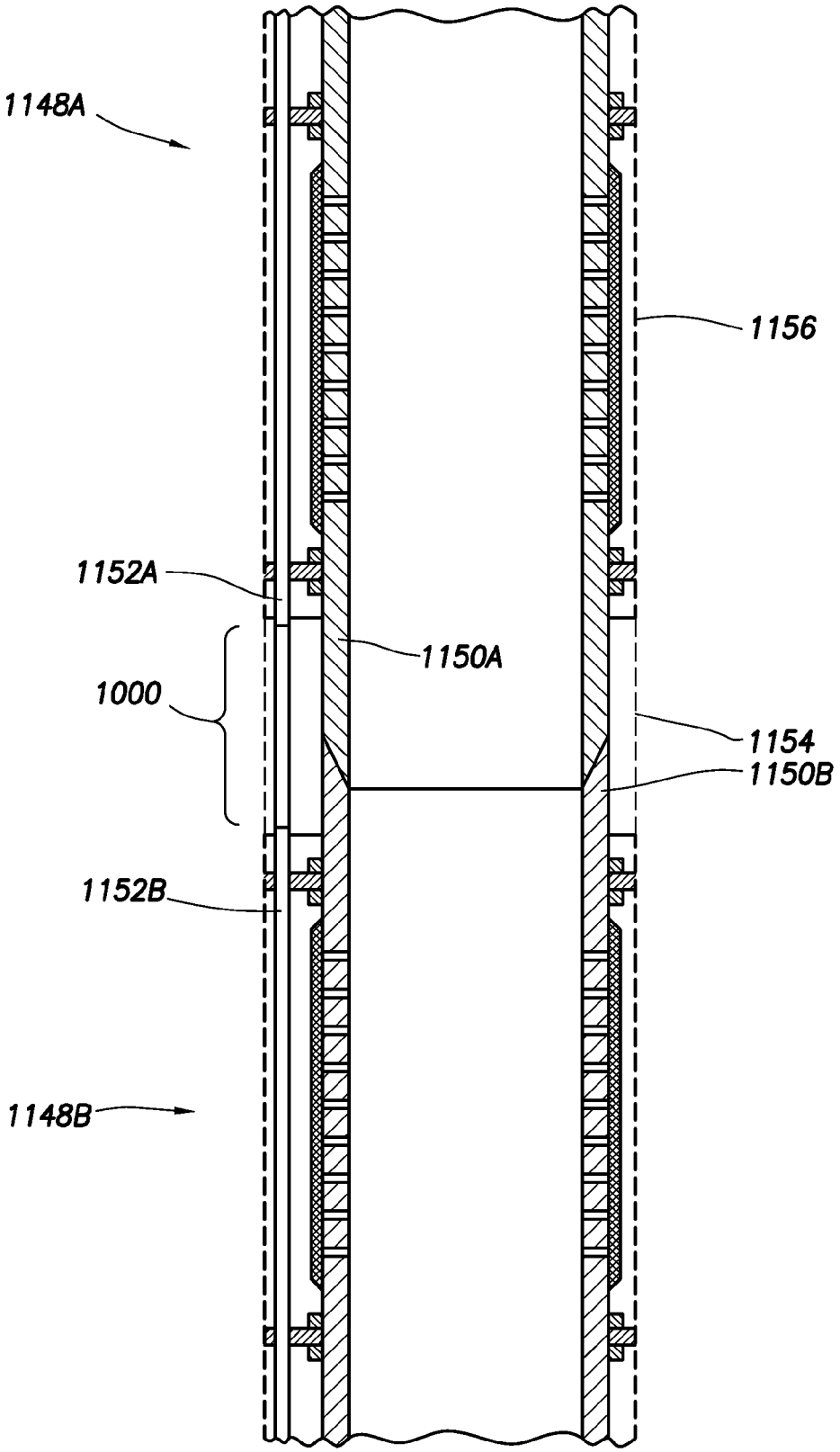

Once the adjacent shunt tubes 1152A, 1152B are substantially aligned, a jumper tube 1000 may be used to provide a fluid coupling between the adjacent shunt tubes 1152A, 1152B. In an embodiment, the jumper tube 1000 (depicted in FIG. 11B) may be coupled to the adjacent ends of the adjacent shunt tubes 1152A, 1152B. One or more seals (e.g., o-ring seals, etc.) may be used to provide a fluid tight connection between the jumper tube 1000 and the end of the respective shunt tubes 1152A, 1152B. Similar jumper tubes 1000 may be used to couple any additional shunt tubes 1152A and/or packing tubes being fluidly coupled between the adjacent joints of wellbore tubulars 1150A, 1150B.

To couple the shunt tubes 1152A and/or packing tubes between the adjacent joints of the wellbore tubular 1150A, 1150B, the jumper tube 1000 may be disposed between shunt tubes 1152A and 1152B. Once the jumper tube 1000 is disposed between the shunt tubes 1152A and 1152B, the end of the first tubular member 902 (depicted in FIG. 9) may be coupled with the shunt tube 1152B. Shunt tube 1152B may be the shunt tube disposed in the downstream direction of the fluid flow between shunt tube 1152A and 1152B once the jumper tube couples with shunt tubes 1152A and 1152B. The length of the jumper tube 1000 may be axially increased by axially displacing the second tubular member 904 from within the first tubular member 902 (also depicted in FIG. 9) so that second tubular assembly 904 may be coupled with the shunt tube 1152A. In an embodiment, the first tubular member 902 may be coupled with shunt tube 1152B and the second tubular member 904 may be coupled with shunt tube 1152A.

Depending on the configuration of the locking member 906, the locking member 906 may be engaged on the second tubular member 904 before or after the second tubular member 904 is coupled with the shunt tube 1152A. Regardless of when the locking member is engaged on the second tubular member 904, the locking member 906 may be axially displaced along the second tubular member 904 until the locking member 906 engages both the second tubular member 904 and the first tubular member 902. The locking member 906 may be disposed with grooves which complimentarily engage groves disposed on the surface of the second tubular member 904. The coupling of the grooves disposed on the locking member 906 and the second tubular member 904 in conjunction with the engagement of the locking member 906 and the first tubular member 902 may prevent the second tubular member 904 from axially displacing into the first tubular member 902. This locking feature may prevent the jumper tube 1000 from disengaging from the shunt tubes 1152A and 1152B. The coupling of the grooves disposed on the locking member 906 and the second tubular member 904 in conjunction with the engagement of the locking member 906 and the first tubular member 902 may also facilitate a sealing engagement between the first and second tubular member 902, 904 as well as the shunt tube 1152A, 1152B with the jumper tube 1000. Additionally, the seals and the optional back-up seals may facilitate sealing engagement between the first and second tubular member 902, 904 as well as the shunt tubes 1152A, 1152 with the jumper tube 1000. In an embodiment, locking the jumper tube 1000 may further comprise engaging the locking member 906 into a locking member housing 712 between the first tubular member 902 and the second tubular member 904. In an embodiment, locking the jumper tube 1000 may further comprise engaging the locking member in the locking member housing 712 with frictional grooves 714 (depicted in FIG. 7B). These features may prevent axial movement of the locking member 906 to prevent the second tubular member 904 from axially displacing into the first tubular member 902 disengaging the jumper tube 1000 from the shunt tubes 1152A and 1152B.

Having fluidly coupled the shunt tubes 1152A, 1152B and any additional tubes on the adjacent joints of wellbore tubulars 1150A, 1150B, an additional shroud 1154 may be used to protect the jumper tubes 1000. In an embodiment, the shroud 1154 may be similar to the outer body member 1156, and may be configured to be disposed about the jumper tube section 1000 to prevent damage to the jumper tubes 1000 and ends of the adjacent shunt tubes 1152A, 1152B during conveyance within the wellbore. Once the adjacent wellbore tubulars 1150A, 1150B are coupled and the shroud 1154 has been engaged, additional joints of wellbore tubulars may be similarly coupled to the existing joints and/or additional wellbore tubulars may be used to complete the assembled sand screen structure for use in the wellbore.

Once assembled, the shunt tube assembly comprising one or more jumper tubes and one or more locking members can be disposed within a wellbore for use in forming a sand screen. Referring again to FIG. 1, after the assembled sand screen structure is installed in the wellbore 114, a packing sand/gel slurry can be forced downwardly into the annulus between the casing and the sand screen to form the pre-filtering sand pack around the screen structure. In the event that an annular sand bridge is created externally around the sand screen structure, the slurry is caused to bypass the sand bridge by flowing into the shunt tubes downwardly through the shunt tubes, and then outwardly into the casing/sand screen annulus beneath the sand bridge. When flowing through the shunt tubes, the packing sand/gel slurry may pass through one or more connections comprising jumper tubes. Sealed connections between the shunt tubes and the jumper tubes comprising first tubular members and second tubular members which also have sealed connections between them provide for a flow path for packing sand/gel slurry from a first shunt tube assembly to a second shunt tube assembly. Once the gravel pack has been formed as desired, a fluid may be allowed to flow through the gravel pack, through the slots in the outer body member, through the filter media, and into the throughbore of the wellbore tubular where it may be produced to the surface.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A shunt tube assembly to be mounted alongside a base pipe assembly, the shunt tube assembly comprising:

a first shunt tube having a first end;

a second shunt tube having a first end; and a jumper tube assembly fluidly connecting the first shunt tube and the second shunt tube, wherein the jumper tube assembly comprises:

a first tubular member engaged with the first end of the first shunt tube;

a second tubular member disposed within the first tubular member, wherein the second tubular member telescopically and slidingly engages within the first tubular member, and wherein the second tubular member is extended to engage with the first end of the second shunt tube; and a locking member that engages the first tubular member and the second tubular member, and wherein the locking member prevents the second tubular member from telescopically and longitudinally displacing further into the first tubular member when the locking member engages both the first tubular member and the second tubular member.

2. The shunt tube assembly of claim 1, wherein the locking member is engaged with at least a portion of an outer surface of the second tubular member.

3. The shunt tube assembly of claim 1, wherein the locking member is engaged with an inner surface of the first tubular member.

4. The shunt tube assembly of claim 1, wherein the locking member maintains engagement between the jumper tube assembly and the shunt tube assembly.

5. The shunt tube assembly of claim 1, wherein the locking member maintains a sealing engagement between the jumper tube assembly and the shunt tube assembly.

6. The shunt tube assembly of claim 1, wherein the locking member comprises frictional grooves on at least one face, and wherein the frictional grooves prevent longitudinal movement of the locking member along a longitudinal axis of the jumper tube assembly.

7. The shunt tube assembly of claim 1, wherein the second tubular member comprises grooves disposed on an outer surface of the second tubular member, and wherein the grooves prevent longitudinal movement of the locking member along a longitudinal axis of the second tubular member.

8. The shunt tube assembly of claim 1, further comprising at least one seal disposed between the first tubular member and the second tubular member, wherein the at least one seal sealingly engages the first tubular member and the second tubular member.

9. The shunt tube assembly of claim 1, wherein the first tubular member engages at least a portion of the locking member.

10. The shunt tube assembly of claim 1, wherein a portion of the locking member is disposed between an inner surface of the first tubular member and an outer surface of the second tubular member.

11. The shunt tube assembly of claim 1, wherein the first tubular member comprises frictional grooves disposed on an inner surface of the first tubular member, and wherein the frictional grooves prevent longitudinal movement of the locking member along a longitudinal axis of the first tubular member.

12. The shunt tube assembly of claim 1, wherein the locking member comprises a c-ring, wherein the c-ring comprises frictional grooves disposed on an inner surface, and wherein the frictional grooves prevent longitudinal movement of the locking member along a longitudinal axis of the first tubular member.

13. The jumper tube assembly of claim 12, wherein the second tubular member comprises frictional grooves disposed on an outer surface, wherein the c-ring is disposed about the second tubular member, and wherein the frictional grooves disposed on the inner surface of the c-ring engage the frictional grooves disposed on the outer surface of the second tubular member.

14. A jumper tube assembly for use with a shunt tube assembly comprising:

a first tubular member capable of engaging a first end of a first shunt tube;

a second tubular member axially disposed within the first tubular member, wherein the second tubular member is capable of extending into engagement with a first end of a second shunt tube, wherein the second tubular member has an outer surface in contact with the inner surface of the first tubular member, and wherein the second tubular member comprises circumferential grooves disposed on the outer surface of the second tubular member;

a locking member engaging the outer surface of the second tubular member, the locking member comprising circumferential grooves on an inner surface, and wherein the circumferential grooves of the second tubular member interact with the circumferential grooves of the locking member to prevent further longitudinal movement of the second tubular member into the first tubular member.

15. The jumper tube assembly of claim 14, wherein the locking member comprises a c-ring.

16. The jumper tube assembly of claim 14, wherein the locking member engages the first tubular member and the second tubular member.

* * * * *